United States Patent [19]

Hwang

[11] Patent Number: 4,814,206

[45] Date of Patent: Mar. 21, 1989

[54] PROCESS FOR TREATING TEXTILE FABRICS WITH WATER REPELLENT

[76] Inventor: Moo Y. Hwang, Room No. 10-802, Woo Song Apt. 90-1, Socho-dong, Kangnam-gu, Seoul, Rep. of Korea

[21] Appl. No.: 44,154

[22] Filed: Apr. 30, 1987

[30] Foreign Application Priority Data

Aug. 7, 1986 [KR] Rep. of Korea ..... 61-6541 [U]

[51] Int. Cl.[4] ..... B05D 3/02

[52] U.S. Cl. ..... 427/393.4; 427/389; 428/264; 428/265; 428/270

[58] Field of Search ..... 427/393.4, 389; 428/264, 265, 270

[56] References Cited

U.S. PATENT DOCUMENTS

| | | | |
|---|---|---|---|
| 3,816,167 | 6/1974 | Schultz et al. | 427/393.4 X |
| 4,477,498 | 10/1984 | Deiner et al. | 427/393.4 X |
| 4,518,649 | 5/1985 | Wang et al. | 427/393.4 X |

*Primary Examiner*—Michael Lusignan

*Attorney, Agent, or Firm*—Price, Heneveld, Cooper, DeWitt & Litton

[57] ABSTRACT

A process for treating textile fabrics comprising contacting said fabrics at an elevated temperature with a fluorine-containing polymer composition comprising form 3 to 7 weight percent of fluorine-containing polymer, 0.1 to 0.3 weight percent of melamine resin and 1 to 4 weight percent curing catalyst.

9 Claims, No Drawings

PROCESS FOR TREATING TEXTILE FABRICS WITH WATER REPELLENT

THE FIELD OF APPLICATION OF THE INVENTION

The present invention relates to a novel process for treating various textile fabrics with water repellent, characterized in reacting said textile fabrics with fluorine water repellent and melamine resin by heating, in the presence of curing catalyst.

BACKGROUND OF THE INVENTION

Heretofore, several kinds of fluorine resin products have been known as water repellent for the treatment of textile fabrics, but the water repellency of textile fabrics treated therewith is easily aged or disappears after being washed four times. Accordingly in the past, a number of researches and experiments have been made to improve the life of textile products without satisfactory results, and the conventional methods are still employed despite their inconvenience in the textile industries.

DETAILED DESCRIPTION OF THE INVENTION

Therefore, the object of the present invention is to eliminate such disadvantages of the conventional process using fluorine resin, and to provide a novel process for the water repellent treatment of various textile fabrics such as cotton, wool, hemp and silk fabrics. The present invention may best be understood by reference to the following description and the subject matter which I regard as my invention particularly pointed out and distinctly claimed in the concluding portion of this specification.

In accordance with the present invention, textile fabrics are reacted with fluorine water repellent, using a medium of the reactive intermediate resin, to obtain an outstanding water repellency with a good fastness to washing.

Furthermore, if the water repellent treatment is conducted while using at the same time various processing materials such as preservatives, deodorizers, wrinkle-proofing agents, and anti-electrostatic agents which are hitherto known only as simple textile processing agents, the textile treating processes will be then substantially simplified in one and the same process, and said melamine resin medium, being composed of the afore-mentioned various textile processing materials including a touch-improving agent, produces outstanding textile fabrics of high quality having excellent touch, and at the same time allowing the various different secondary textile treatments to be carried out in a single process.

In accordance with the present invention, textile fabrics to be treated may include all kinds of textiles made of not only synthetic fiber such as polyester fiber but also natural fiber, particularly animal fibers such as wool and silk which have been heretofore considered extremely difficult or almost impossible of processing with chemicals.

As for the textile processing material, one must select proper treating agents such as an intermediate resin medium, water repellent catalyst, penetration catalyst, anti-electrostatic agent and mold repellent, according to the fabrics to be processed, such as synthetic, cotton, woolen, and silk fabrics as well as according to the requirements of the finished products, such as wrinkle-proof, contractility, water repellency and touch.

The reactive intermediate resin medium according to the present invention reacts with the water repellent fluorine compound, such as a polyfluoroethylene acrylic acid copolymer. It is essential that the reaction be carried out at the processing temperature. Since said intermediate resin medium easily causes the dimethanization reaction at a pH acid by heating, the hardener polymethoxymethylmelamine and the like are often employed. Particularly, the organo-thyalsol compounds are effectively employed as disinfectants or moth-repellents.

Penetrants are essential for the treatment of animal fibers which is considered one of the important features of the present invention. Ethylene oxide polymers having a molecular weight of several million are generally used. Besides, polyvinyl pyrrolidone employed in connection with the penetrants is particularly important in view of its various functions such for as touch-improvement and acting as an anti-electrostatic agent. Furthermore, it is also important that potassium bichromate is used for silk fabrics.

Preferred embodiments of the process in accordance with the present invention are described as follows:

EXAMPLE 1

According to the present invention, two samples A and B of polyester fabrics were treated with water repellent by utilizing the following treatment bath and tested for the water repellency in the Textile Industry Laboratory in Tokyo City. The test results are as follows: The following materials were mixed to prepare a water repellent bath.

| | |
|---|---|
| SKG-620 (water repellant flourine-containing compound): | 3–9% |
| T-30 (amine catalyst produced by SAM JEONG CHEMICALS Co.): | 1–4% |
| P (methylol melamine mixing agent produced by SAM JEONG CHEMICALS Co.): | 0.1–0.3% |
| Water: | Remainder % |

The above sample fabrics were tested with the said water repellent bath.

| No. of Cleaning | 5 | 10 | 15 | 20 | 30 | 40 | 45 | 50 | 50 |
|---|---|---|---|---|---|---|---|---|---|
| | | | | Dry Cleaning | | | | | |
| A | 90 | 90 | 90 | 80 | 80 | 80 | 80 | 70 | 80 |
| B | 100 | 100 | 90 | 83 | 80 | 70 | 70 | 70 | 93 |
| | | | | Wet Cleaning | | | | | |
| A | 93 | 90 | 90 | 80 | 80 | 80 | 80 | 80 | 90 |
| B | 100 | 100 | 100 | 100 | 100 | 100 | 100 | 100 | 100 |

Note:
The test method was based on JISL 1097–1977, 1018 E2 and 0217103.
The symbol * represents that the sample fabrics were pressed by means of household electric iron at the temperature for polyester fabrics.

EXAMPLE 2

Three sample fabrics were treated with water repellent in the treating bath having the same composition as in Example 1, and these three samples and an untreated sample were subjected to a durability test conducted by Technical Laboratory of the SAM JEONG CHEMICALS Co., Ltd. The results of the above test are as follows:

Said samples were cleaned in the soapy water of 0.2% of neutral detergent, at 40° C., for 10 minutes, by means of a household electric washing machine, and then washed with water for 10 minutes, by subjecting to severe washing for 5 minutes, and to soft washing for 5 minutes while automatically reversing, and after squeezing water, the sample fabrics were dried for 5 minutes at 100° C.

| Test No. | Color | Number of washing times 0 | 3 | 5 | 10 |
|---|---|---|---|---|---|
| 1 | blue | 100 | 100 | 100 | 100 |
| 2 | blue | 100 | 100 | 100 | 100 |
| 3 | light brown | 100 | 100 | 100 | 100 |
| Untreated | blue | — | — | — | — |

EXAMPLE 3

Cotton and hemp fabrics were tested in the treating bath containing the following compositions. The fabrics treated by the above composition bath were all ascertained to have remarkable durabilities.

| Constituents of the bath | Bath No. No. 1 | No. 2 | No. 3 | No. 4 | No. 5 | No. 6 |
|---|---|---|---|---|---|---|
| SKG-620 (Name of fluorine product) | 6 | 6 | 6 | 6 | 6 | 6 |
| T-30(name of melamine product) | 2 | 2 | 2 | 2 | 2 | 2 |
| P (name of methylol melamine product | 0.2 | — | — | 0.1 | 0.1 | 0.1 |
| KR-58 (flexibilizer) | 1 | 1 | 1 | 1 | 1 | 1 |
| SFZ (catalyst) | 0.2 | 0.2 | — | 0.15 | 0.15 | 0.15 |
| Potassium bichromate (catalyst) | — | 0.1 | 0.1 | 0.25 | 0.25 | 0.25 |

EXAMPLE 4

In order to treat woolen fabrics with water repellent, the following treating baths containing respective compositions as given in the table below were employed. According to the above test results, all woolen fabrics treated by the above baths have shown better durabilities than those of any other woolen fabrics processed by conventional methods, and the touch of said fabrics were excellent while retaining the peculiar properties of wool.

| Constituents of Bath | Bath No. No. 1 | No. 2 | No. 3 | No. 4 | No. 5 | No. 6 |
|---|---|---|---|---|---|---|
| SKG-620 | 5 | 5 | 5 | 5 | 5 | 5 |
| T-30 | 2 | 2 | 2 | 2 | 2 | 2 |
| P | 0.2 | — | — | 0.1 | 0.1 | 0.1 |
| HS (catalyst) | 1 | 1 | 1 | 1 | 1 | 1 |
| KR-58 (plasticizer) | 2 | 2 | 2 | 2 | 2 | 2 |
| AS (polyethelene oxide-containing polymer) | — | 0.1 | 0.1 | 0.25 | 0.35 | 0.35 |

EXAMPLE 5

In order to treat silk fabrics with water repellent, treating baths containing the following compositions were employed. The fabrics treated with said treating baths showed better durabilities than those of silk fabrics treated by the conventional methods, while retaining the original touch peculiar to silk goods as prior to the treatments.

| Constituents of Bath | Bath No. No. 1 | No. 2 |
|---|---|---|
| SKG-620 | 6 | 8 |
| T-30 | 2 | 2 |
| P | 0.1 | 0.1 |
| KR-58 (plasticizer) | 1 | 1 |
| SFZ (catalyst) | 0.15 | 0.15 |
| Potassium bichromate | 0.25 | 0.25 |
| Z-FF (polyvinyl pyrrolidone) | 2 | 2 |
| DIRTPTAT 1600(catalyst) | 0.01 | 0.01 |
| AS (catalyst) | — | 0.5 |
| Water | Remainder % | Remainder % |

EXAMPLE 6

A woolen fabric dyed with an acid dye was treated with water repellent, by means of a treating bath containing the following composition.

| Preparation of treating bath | |
|---|---|
| SKG - 620 | 4–8% |
| T - 30 | 1–3% |
| P | 0.1–0.3% |
| Water | Remainder % |

According to the above test results of said sample fabrics, the untreated fabrics became moldy whereas the treated fabrics did not become moldy at all.

After adding 4–8% of Excell 700 to the treating bath in Example 6, synthetic and woolen fabrics were treated with said water repellent in the above bath, and then subjected to the electrostatic charge test, the results of which are as follows:

| Sample No. | Value of the surface resistance Untreated | Treated |
|---|---|---|
| 1 (wool) | $2.6 \times 10^{12}\ \Omega$ | $2.1 \times 10^{12}\ \Omega$ |
| 2 (polyester) | $2.4 \times 10^{9}\ \Omega$ | $5.5 \times 10^{8}\ \Omega$ |

Note:
For measuring the surface resistance, the super-insulation tester (VE-40) and the normal temperature measuring box (RC-02) both by the KAWAKUCHI DENKI Company in Japan were employed, and the value of surface resistance was measured while applying a voltage of 500 W to the surface of the sample fabrics for one minute, at a temperature of 22° C., and under the relative humidity of 45%.

As can be clearly understood in the above examples, the present invention shall provide a novel process wherein the textile products can be not only easily treated to obtain excellent water repellency, but also various secondary treatments can be effectively conducted simultaneously in a single process, which treatments were otherwise separately conducted using the conventional processes.

I claim:

1. A process for treating various textile fabrics with water repellent, comprising reacting said textile fabrics with from 3 to 9 weight percent of fluorine water repellent by heating, in the presence of from 0.1 to 0.3 weight percent melamine resin medium and from 1 to 4 weight percent curing catalyst, characterized in that said melamine resin medium includes one or more textile treating agents, that said melamine resin medium is trimethoxymelamine and acts as touch-improving agent, that said textile treating agents include any one or more of penetrants, touch-improving agents, preservatives, and anti-electrostatic agents, that said fluorine water repellent is a co-polymer of polyfluoroethylene acrylic acid, that said catalyst includes organo-amine hydrochloride or organo-thiazol compounds, and that said penetrant includes ethylene oxide polymer or polyvinyl pyrrolidone.

2. A process for improving water repellency of natural and synthetic textile fibers comprising:

impregnating said textile fabric with a treating composition comprising:

from 3 to 9 weight percent polyfluoroethylene acrylic acid copolymer;

from 0.1 to 0.3 weight percent melamine resin; and from 1 to 4 weight percent of a cross-linking agent, with the balance comprising water; followed by heating and curing.

3. A process according to claim 2 wherein said treating composition contains from 0.1 to 0.5 weight percent of a polyethylene oxide-containing polymer.

4. A process according to claim 2 wherein said treating composition contains from 0.1 to 0.25 weight percent of potassium bichromate.

5. A process according to claim 3 wherein said composition contains from 0.1 to 0.25 weight percent potassium bichromate.

6. A process according to claim 2 wherein said treating composition contains from 2 weight percent polyvinyl pyrrolidone.

7. A process according to claim 6 wherein said composition contains from 0.1 to 0.25 weight percent potassium bichromate.

8. A process according to claim 7 wherein said treating composition contains from 0.1 to 0.5 weight percent of a polyethylene oxide-containing polymer.

9. A process according to claim 8 wherein said treating composition contains from 0.1 to 0.25 weight percent potassium bichromate.

* * * * *